US006142806A

United States Patent [19]

Yamashita et al.

[11] Patent Number: 6,142,806

[45] **Date of Patent: *Nov. 7, 2000**

[54] INSERT MOULDED PRODUCT AND METHOD OF MANUFACTURE THEREOF

[75] Inventors: Kazunori Yamashita; Mitsuhiro Fujitani, both of Yokkaichi, Japan

[73] Assignee: Sumitomo Wiring Systems, Ltd., Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/042,712

[22] Filed: Mar. 17, 1998

[30] Foreign Application Priority Data

Mar. 31, 1997 [JP] Japan ..... 9-080530

[51] Int. Cl.[7] ..... H01R 4/60

[52] U.S. Cl. ..... 439/212; 439/736

[58] Field of Search ..... 439/76.1, 76.2, 439/212, 723, 949, 736, 209, 210, 216; 428/172; 29/854, 855, 856, 857, 858, 882

[56] References Cited

U.S. PATENT DOCUMENTS

| | | | |
|---|---|---|---|
| 1,957,530 | 5/1934 | Dibner | 470/13 |
| 2,123,041 | 7/1938 | Hansen | 470/13 |
| 2,351,630 | 6/1944 | O'Brien | 439/216 |
| 3,857,154 | 12/1974 | Hammond et et al. | 29/203 P |
| 3,990,864 | 11/1976 | Rozmus | 29/630 |
| 4,043,630 | 8/1977 | Suverison et al. | 339/218 |
| 5,097,592 | 3/1992 | Schultz, Jr. et al. | 439/736 |
| 5,240,757 | 8/1993 | Schad et al. | 428/172 |
| 5,423,120 | 6/1995 | Kaneko | 29/874 |
| 5,475,921 | 12/1995 | Johnston | 29/878 |
| 5,780,774 | 7/1998 | Ichikawa et al. | 174/88 |

FOREIGN PATENT DOCUMENTS

| | | |
|---|---|---|
| 0 653 278 | 5/1995 | European Pat. Off. . |
| 44 05 919 | 8/1995 | Germany . |
| 7-137090 | 5/1995 | Japan . |
| 2 282 932 | 4/1995 | United Kingdom . |

*Primary Examiner*—Gary F. Paumen
*Assistant Examiner*—Ross Gushi
*Attorney, Agent, or Firm*—Banner & Witcoff, Ltd.

[57] ABSTRACT

A wiring member 20 is provided in a housing 10, has a round cross-section, and has integral tab shaped contact members 21 at the ends thereof. The wiring member 20 is bent into a specified shape before the contact members 21 are formed. The wiring member 20 is then fixed in a first moulding and encapsulated by insert moulding of a cover. Since the wiring member 20 is cross-sectionally round, it can be bent in any direction. Consequently, there is a high degree of freedom of design and the bending operation can be carried out easily. Further, as the process for forming the contact members 21 is carried out after the bending process, the accuracy is improved.

10 Claims, 9 Drawing Sheets

INSERT MOULDED PRODUCT AND METHOD OF MANUFACTURE THEREOF

TECHNICAL FIELD

The present invention relates to an insert moulded part having an electrical conductor provided therein, and a production method thereof.

BACKGROUND TO THE INVENTION

A prior insert moulded item of this sort is described in Japanese patent document Tokkaihei 7-137090, and illustrated in FIG. 15 of the accompanying drawings. A connector block 1 is an insert moulded item and has a wiring member 3 made from an electrically conductive metal strip having a connecting tab 4 at one end. The wiring member 3 is located inside a housing 2 made from synthetic resin.

However, since the wiring member 3 is a flat strip-like object, it cannot easily be bent in a direction other than the direction of the thickness of the plate. For this reason, a problem arises in that the degree of freedom of design regarding the bent shape of the wiring member 3 is confined.

The present invention has been developed after taking the above problem into consideration and presents an insert moulded item and its production process wherein the degree of freedom of design regarding the bent shape of the wiring member is greater and the bending operation is relatively easy.

SUMMARY OF THE INVENTION

According to the invention there is provided an insert moulded part having an encapsulated electrical conductor, the conductor being elongate and having one protruding end constituting an electrical connector, wherein the conductor is round in cross-section, is bent in mutually perpendicular planes and has one end formed in a tab shape to constitute said protruding end.

A round conductor is especially suitable for bending in several planes, and has ends capable of being formed into tab-like connectors for attachment to other electrical components. The tab-like connector is preferably formed by pressing after the conductor has been bent to the desired shape; in this way the precise orientation of the tab need not be determined prior to bending. This is especially advantageous if tabs are to be formed at both ends of the conductor. The integral tab also avoids the cost and effort of attaching a separate electrical connector.

Preferably the base moulding has a pre-defined path for the conductor, and in the preferred embodiment several snap fitting jaws are provided to hold the conductor in position whilst the conductor is encapsulated.

Several conductors having substantially parallel paths may be provided side by side.

BRIEF DESCRIPTION OF DRAWINGS

Other features of the invention will be apparent from the following description of several preferred embodiments shown by way of example only in the accompanying drawings, in which.

DESCRIPTION OF PREFERRED EMBODIMENTS

A first embodiment of the present invention is described below with the aid of FIGS. 1 to 12. An insert moulded item of the present embodiment is, for example, a timing belt cover for attachment to the engine of a car. This is shown in its entirety in FIG. 1. The timing belt cover has a wiring member 20 (see FIG. 2) made from electrically conductive metal and located inside a moulded housing 10 of synthetic resin.

Figure 1:
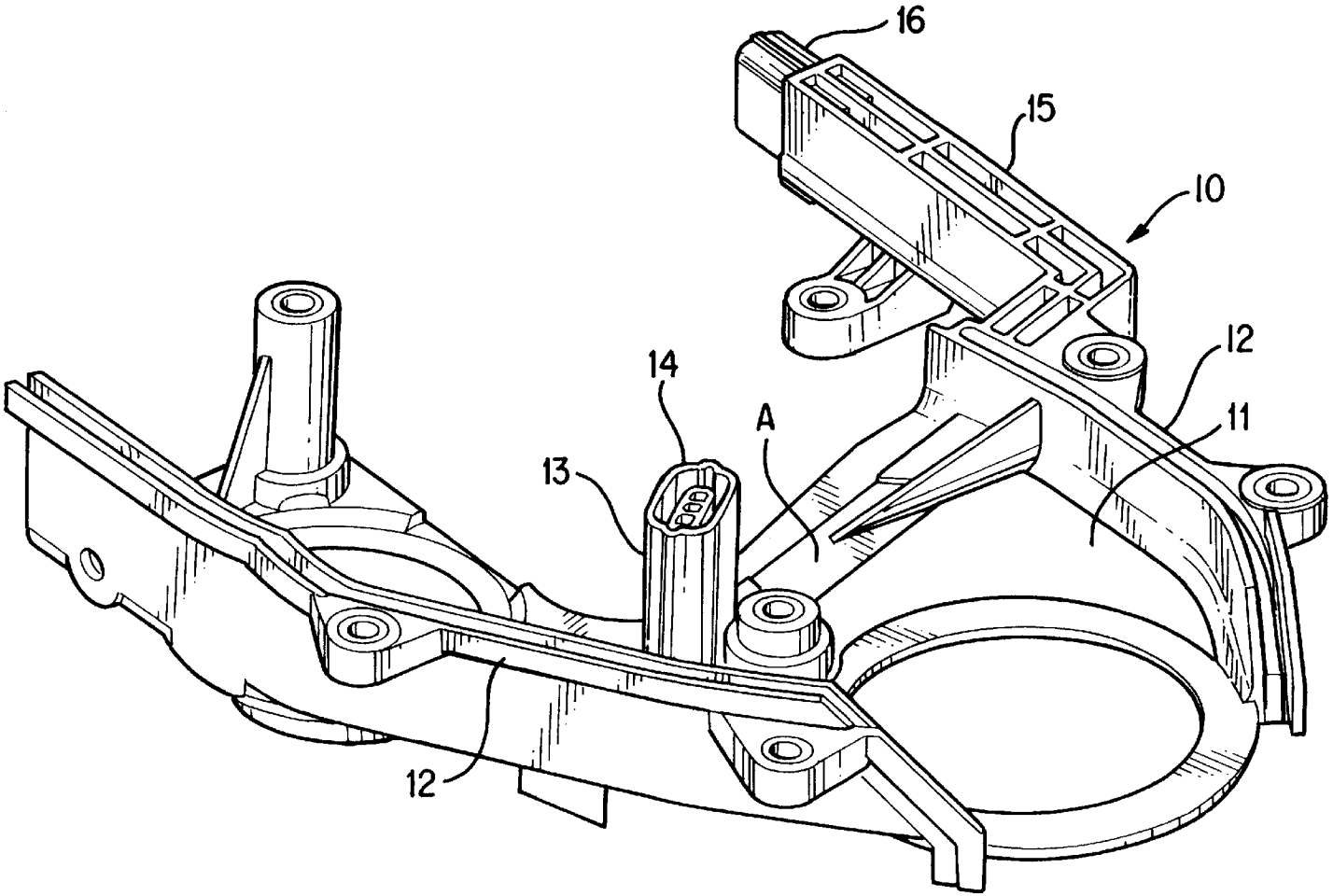
FIG. 1 is a diagonal view of an insert moulded item of the first embodiment of the present invention.

As shown in FIG. 1, the housing 10 comprises a main member 11 which has a flat plate shape, and a pair of peripheral walls 12 protruding towards the attachment face of the engine from the external edge of the main member 11. The timing belt is covered and protected by means of these peripheral walls 12. The main member 11 has a tower 13 that extends towards the engine, the anterior end of the tower 13 having a hood shaped first connector member 14 formed thereon. The external side face of a peripheral wall 12 has a schematically L-shaped arm member 15 extending therefrom, the anterior end thereof having a hood shaped second connector member 16.

Figure 2:
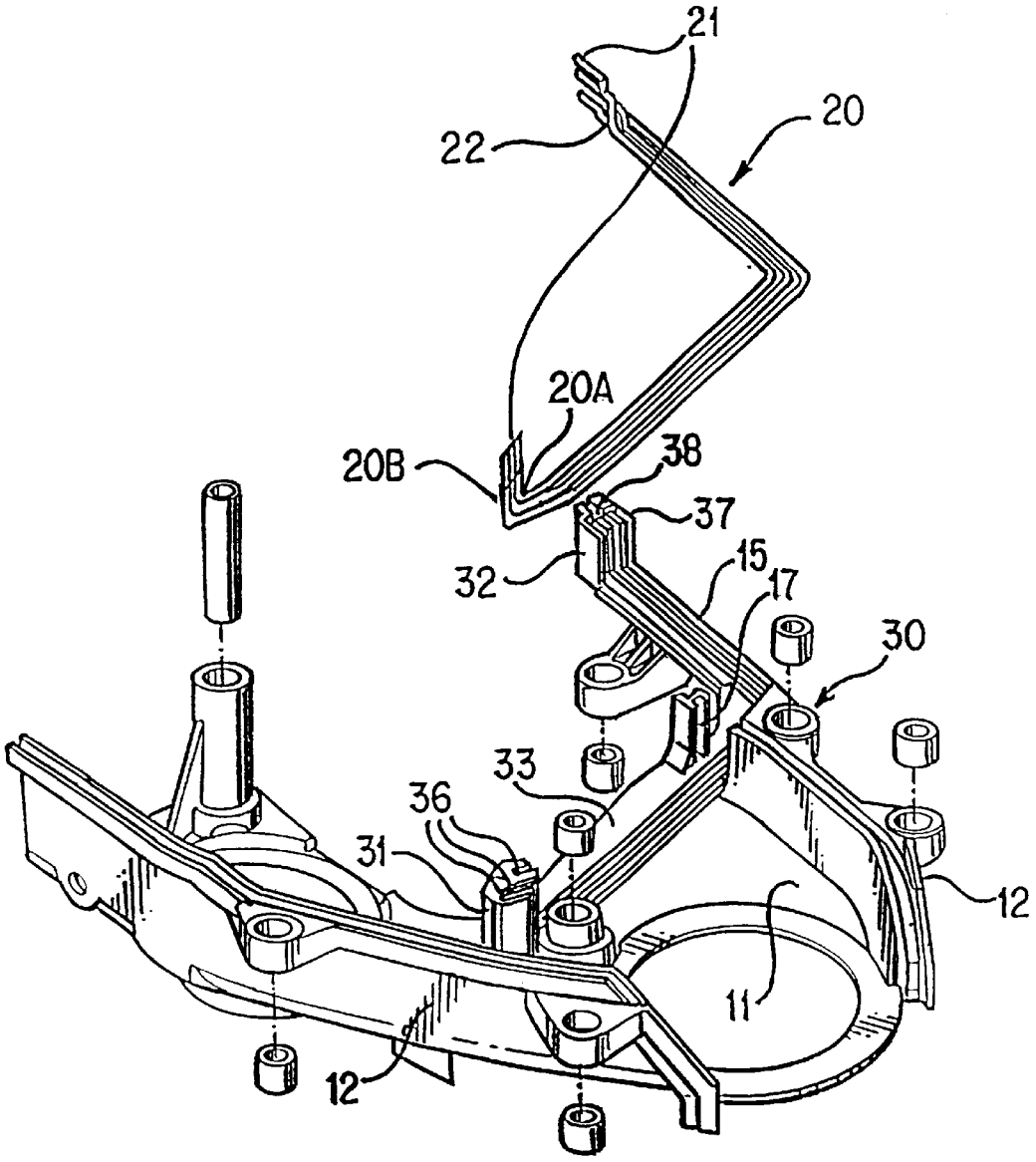
FIG. 2 is a diagonal view of a first moulded item and a wiring member.

As shown in FIG. 2, the wiring member 20 is made from three electrically conductive metal wires that are bent while maintaining a non-contact state, the wires having an approximately round cross-section. Both the ends of the wiring member 20 have tab shaped contact members 21 formed by pressing, these being located in an exposed state within the connector members 14 and 16 (see FIG. 1). The wiring member 20 is bent so as to correspond with electric wiring supporting grooves 33, 36, 37 and 38 provided in the housing 10. Its shape is described below in detail along with the shape of the housing 10.

Regarding the configuration of the moulding, the housing 10 comprises a first moulded item 30 shown partially in FIG. 2 to which the wiring member 20 is attached before the remaining portion is moulded as shown with the completed housing 10 in FIG. 1.

As is clear by comparing FIGS. 1 and 2, the first moulded part 30 constitutes the main part of the housing 10, having a shape excluding an upper portion beneath which the wiring member 20 is located, as shown in FIG. 2. Specifically, the first moulded item 30 comprises the main member 11, the peripheral walls 12 of the housing 10 and the lower face side portions of the arm members 15. The peripheral walls 12 have cut away members 17 formed in positions corresponding to the arm members 15, the portion from the main member 11 to the anterior end of the arm member 15 being connected as a single plane face via the cut away members 17. Furthermore, the first moulded item 30 has tower supporting protrusions 31 for supporting the end portions of the wiring member 20 and arm supporting protrusions 32 formed at portions corresponding to the tower 13 and the end of the arm, respectively. Three supporting grooves 33 follow a bent path so as to be parallel with each other between the supporting protrusions 31 and 32, these supporting grooves 33 serving to support the wiring member 20.

Figure 3:
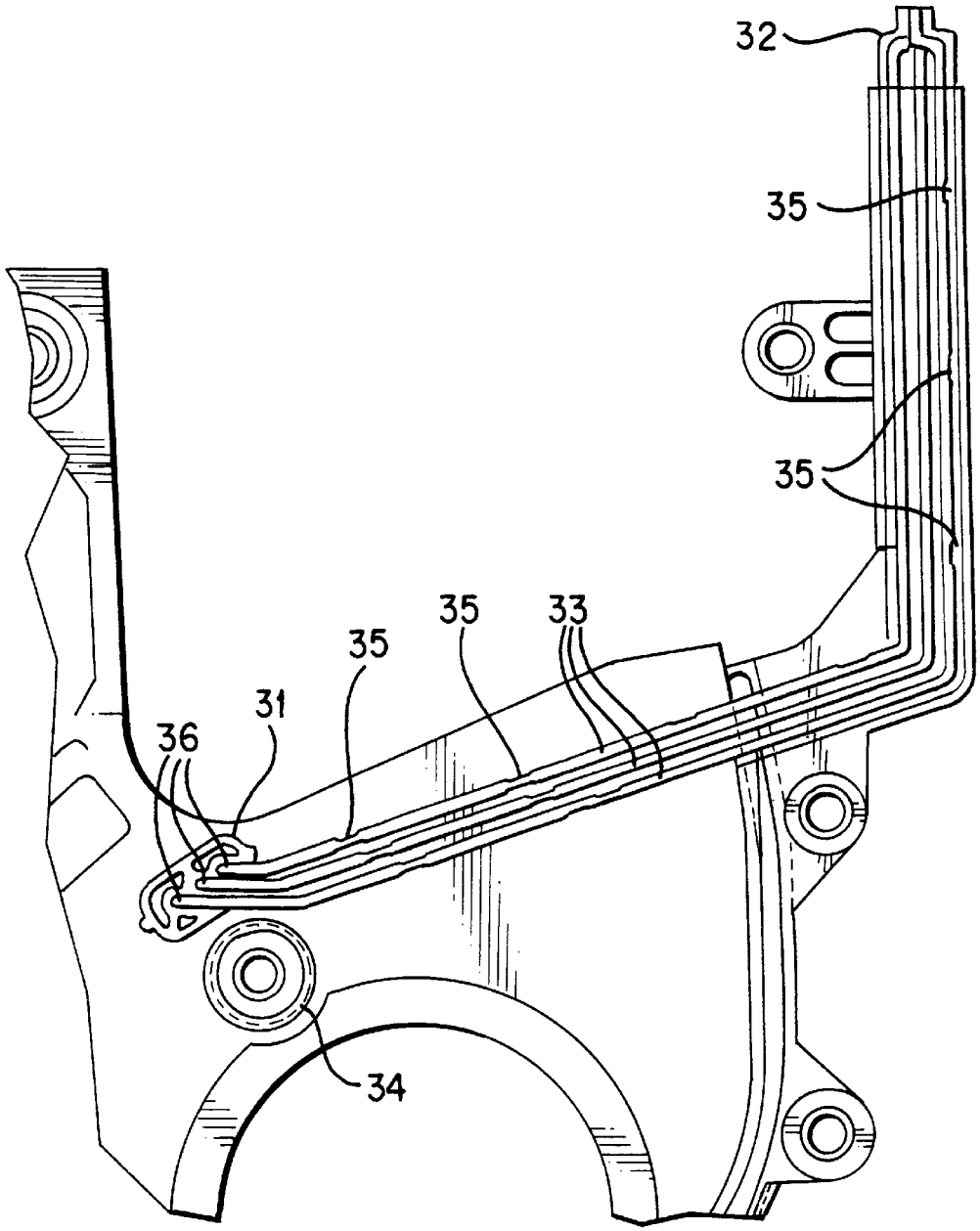
FIG. 3 is a partially cut-away plan view of the first moulded item showing a supporting groove.
Figure 4:
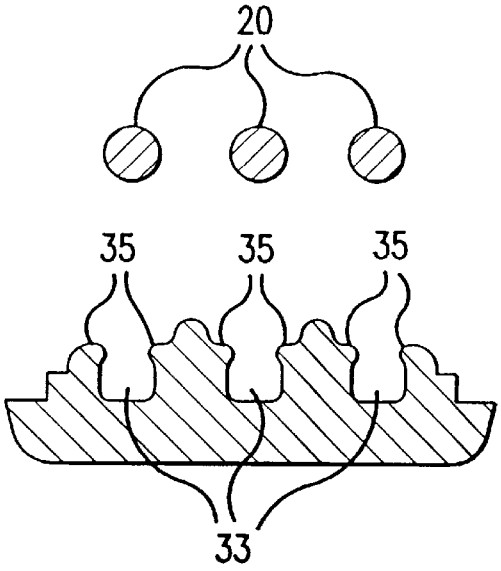
FIG. 4 is a cross-sectional view of an arm member showing the shape of the supporting groove.
Figure 5:
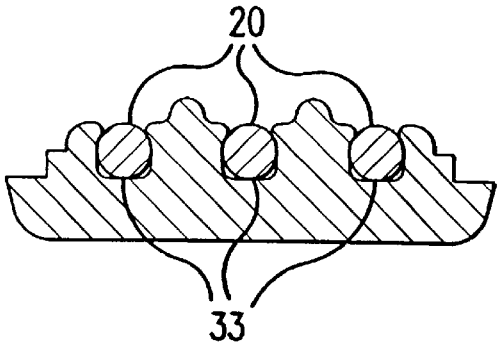
FIG. 5 is a cross-sectional view showing the wiring member in an inserted state in the supporting groove.
Figure 6:
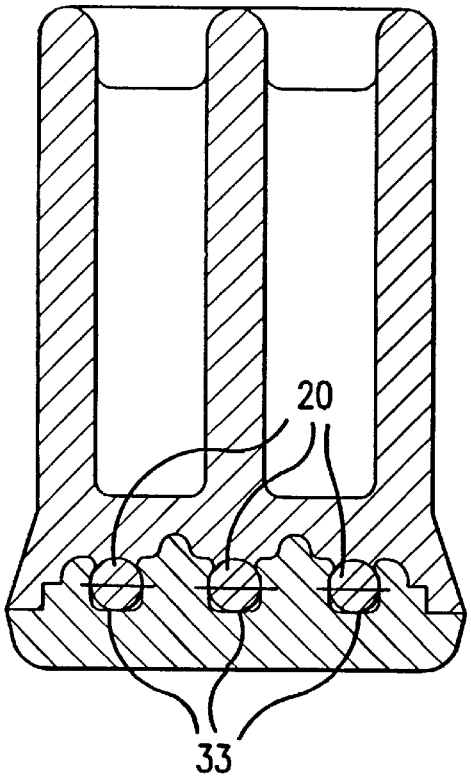
FIG. 6 is a lateral cross-sectional view of the arm member of a housing.

As shown in FIG. 3, the three supporting grooves 33 are aligned along the width-wise direction of the arm member 15 and extend along its length. These continue from the base end member of the arm member 15 to the vicinity of the tower supporting protrusion 31. The supporting groove 33 connects to the tower 13 by bending slightly, as illustrated, in order to avoid the boss 34 that serves to attach the belt cover to the engine. Furthermore, as shown in FIGS. 4 and 5, the supporting groove 33 has a cross-sectionally concave shape, its open ends forming protrusions 35 that face each other in a direction so as to narrow the opening. The space between the protrusions 35 is slightly less than the diameter of the individual wires of the wiring member 20, these wires being retained in a respective supporting groove 33 by force fitting. Further, as shown in FIG. 3, the protrusions 35 are formed only on specified locations on the supporting groove 33, thereby intermittently fixing the wiring member 20.

Three upright grooves 36 are formed inside the tower supporting protrusion 31 (see FIG. 3). The grooves 36 rise up from the supporting grooves 33, the sides towards the supporting grooves 33 being open. Further, when the wiring member 20 is attached to the first moulded item 30 from above the tower 13, the horizontal portions (see 20A in FIG. 2) are housed within the supporting grooves 33 via the open portions of the upright grooves 36, the upright portions (20B in FIG. 2) being thus also housed within the grooves 36.

Figure 7:
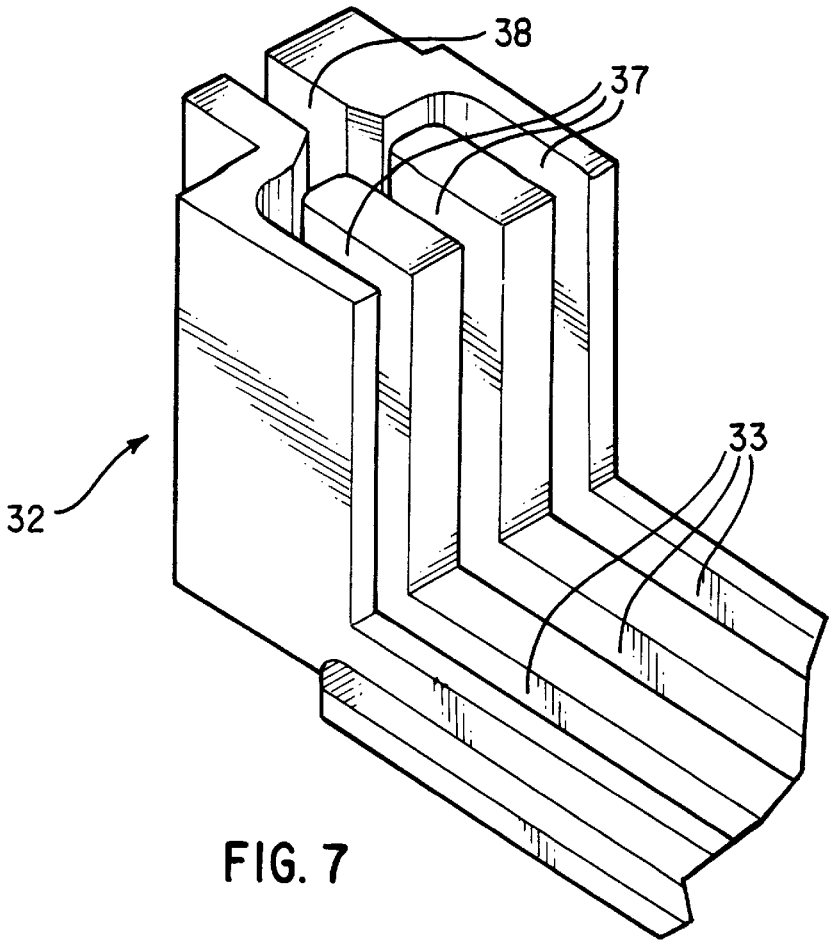
FIG. 7 is a diagonal view of an arm supporting protrusion.

As shown in the enlarged diagram in FIG. 7, the arm supporting protrusion 32 is provided with supporting grooves 37 and a space 38. These serve to support in an aligned upright manner the three wires of the wiring member 20 which are located in a laterally aligned manner within the central portion of the arm member 15.

Figure 9:
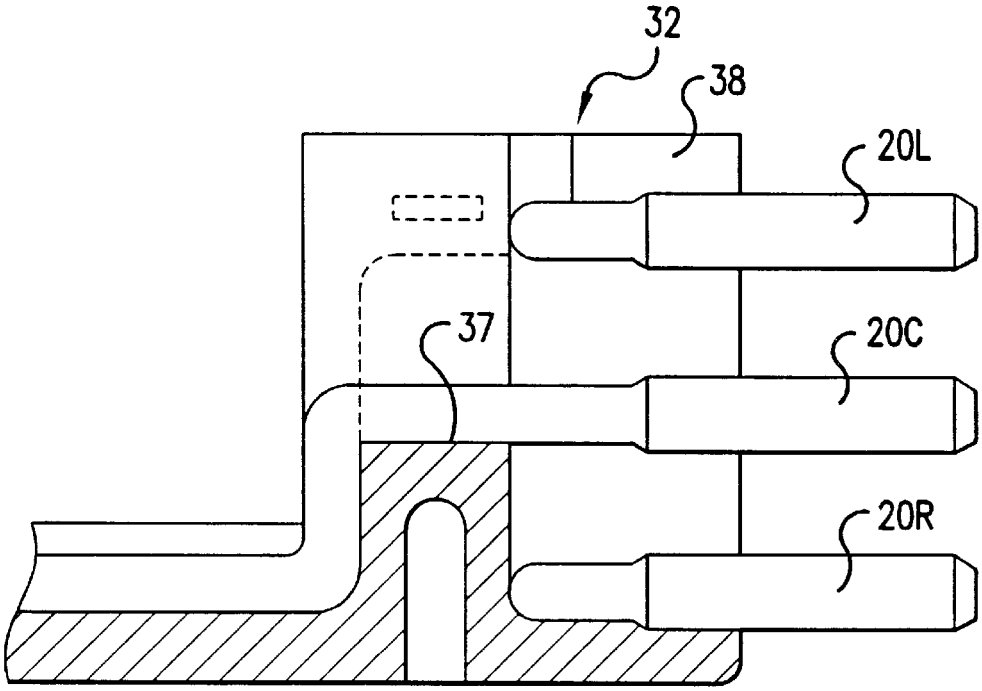
FIG. 9 is a diagonal view of the arm supporting protrusion.
Figure 11:
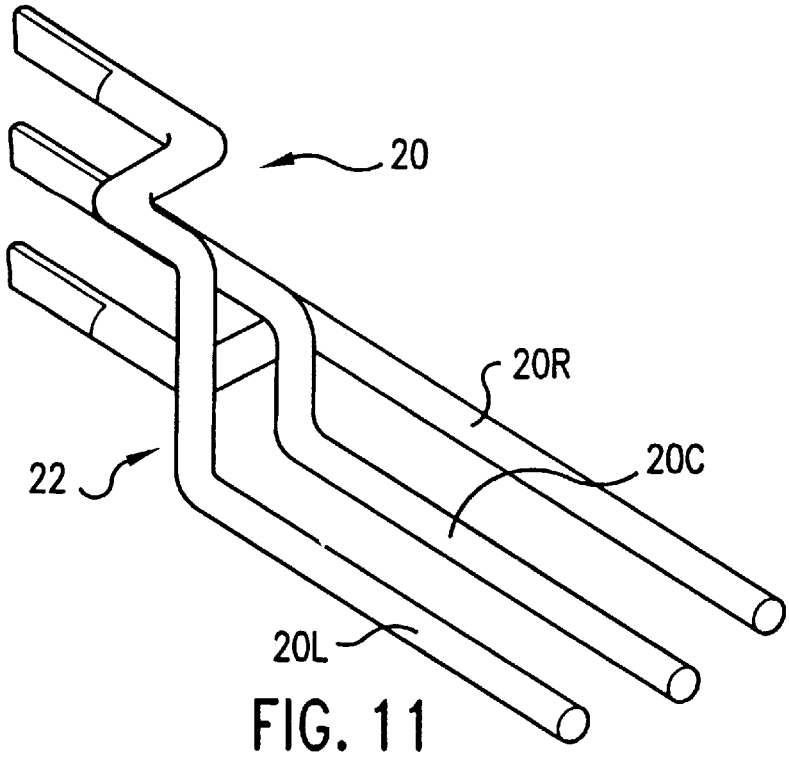
FIG. 11 is a diagonal view showing a bent portion of the wiring member.
Figure 12:
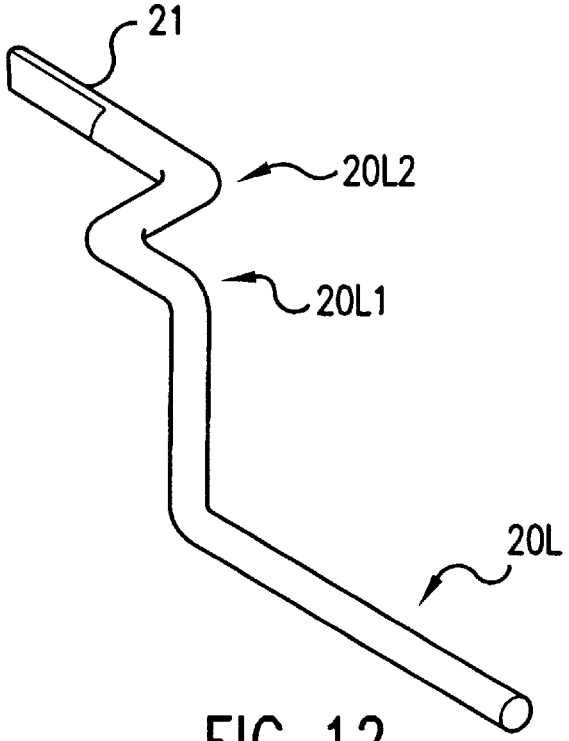
FIG. 12 is a diagonal view showing a portion of the wiring member.

Next, the shape of the bent member (22 in FIG. 2) of the wiring member 20 is described. The bent member 22 is shown in an enlarged manner in FIG. 11. As shown in FIG. 9, the wiring member 20C, shown in FIG. 11 in the central position, is arranged to be cranked in the upright plane. In contrast, the wiring member 20R located to the right in FIG. 11 is located at the lowermost end (see FIG. 9) and is cranked laterally. The wiring member 20L located towards the left in FIG. 11 is located at the highest position (see FIG. 9) and, as shown in detail in FIG. 12, its height is determined by means of an upright crank 20L1 and a lateral crank 20L2.

Figure 8:
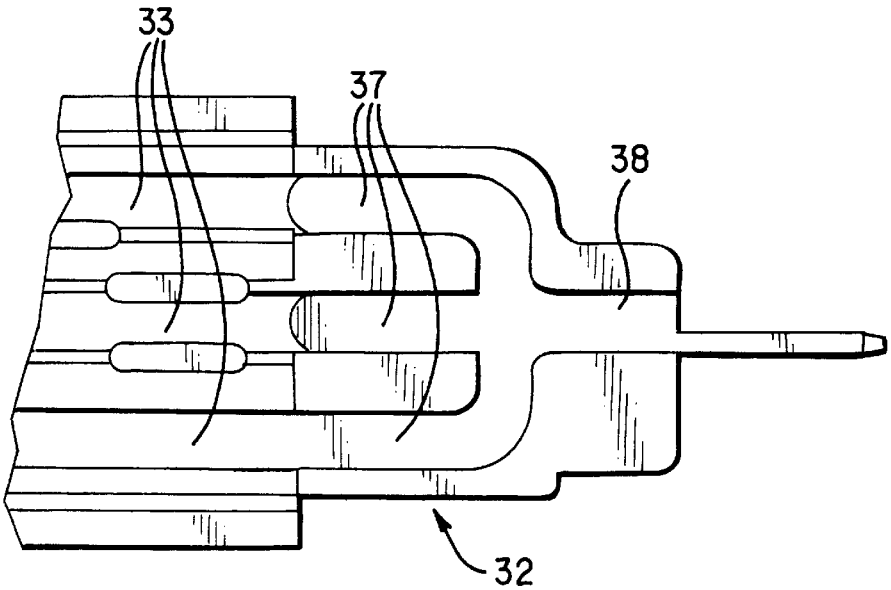
FIG. 8 is a plan view of the arm supporting protrusion.
Figure 10:
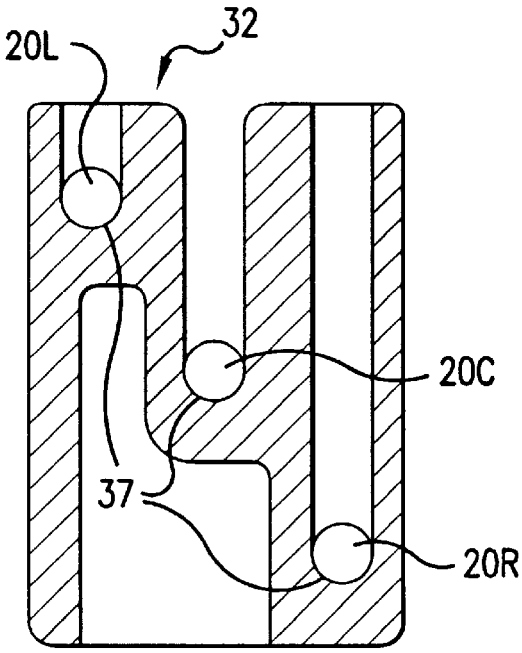
FIG. 10 is a front cross-sectional view of the arm supporting protrusion.

Further, as shown in FIG. 10, the supporting grooves 37 extend in a parallel manner at different heights so as to support the upper ends of the wiring members 20C, 20R and 20L. As shown in FIGS. 7 to 9, the space 38 is formed centrally with respect to the three supporting grooves 37 and extends along their lengthwise direction. In addition, it connects with both the supporting grooves 37 and 38 in the width-wise direction. The wires of the wiring member 20, which have different heights, are aligned so as to be collected towards the centre.

Next, the moulding process of the cover of the present embodiment is explained.

(1) The production method of the wiring member

A wire made of a cross-sectionally round electrically conductive metal is cut into three pieces of specified length. Then, the three pieces of wire are being using a jig (not shown) to the desired shape.

Once the wires are fixed in the jig, both ends of the wires are pressed to a specified extent and the peripheries of the pressed ends are cut, and thus formed in the desired tab shape. In this manner, the contact members 21 of both ends of the wiring member 20 are formed.

Since the wires used to form the wiring member 20 have a cross-sectionally round shape, the wiring member 20 can be bent freely and, for example, there is no limitation of direction, such as when bending a flat bus bar. Accordingly, freedom of design is improved, since there is no constraint on the bending direction. Moreover, when the wiring is set in the jig there is no constraint on the direction in which it faces, which makes operations easy.

The process for forming the tab shape at the end of the wiring member is carried out after the bending process of the wiring member; accordingly the direction in which the contact member 21 faces and its location is not adversely affected due to the direction of bending of the wiring member and its bending. In this manner, freedom of design is again improved and the accuracy of forming the contact member 21 is assured, this accuracy being necessary for a reliable connection.

Moreover, since the contact member 21 is formed by making the end of the wiring member into a tab shape, there is no need to attach an external tab shaped member to the wiring member, thereby reducing production costs.

(2) The attachment process of the wiring member to the first moulded item

The wiring member 20 is attached to the pre-moulded first moulded item 30. The attachment is carried out by attaching the wiring member 20 from its lowest end upwards (see FIG. 11) in an upright manner in the arm supporting protrusion 32.

(3) The second moulding process of the housing

The first moulded item 30 having the wiring member 20 attached thereto is set in an insert mould. The first moulded item 30 is attached to an open mould, the exposed end of the wiring member 20 facing the corresponding mould. Then, as shown by the difference between FIG. 2 and FIG. 1, when the second moulding is carried out by closing the mould, the remaining portion of the housing 10 is formed on the upper end of the wiring member 20 and the hood shaped connector members 14 and 16 are formed at both ends of the wiring member 20 so as to surround the sides of the contact members 21.

The wiring member 20 is thus firmly supported in the first moulded item 30, and there is no possibility of movement to an incorrect position whilst the remaining portion is moulded. Accordingly, better quality is achieved.

Further, in the first moulded item 30 of the present embodiment, the wiring member 20 is exposed in one direction and the second moulded member needs to be added only from this direction. Consequently, compared to the case where the second moulded member has to be added from both sides, the product becomes less thick. Specifically, the portion inside the main member 11 containing the wiring member 20 (the portion shown by the symbol A in FIG. 1) is thinner.

Figure 14:
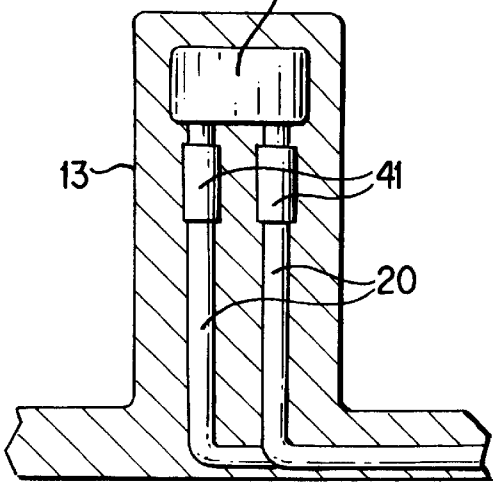
FIG. 14 is a cross-sectional view of a tower of the second embodiment.
Figure 13:
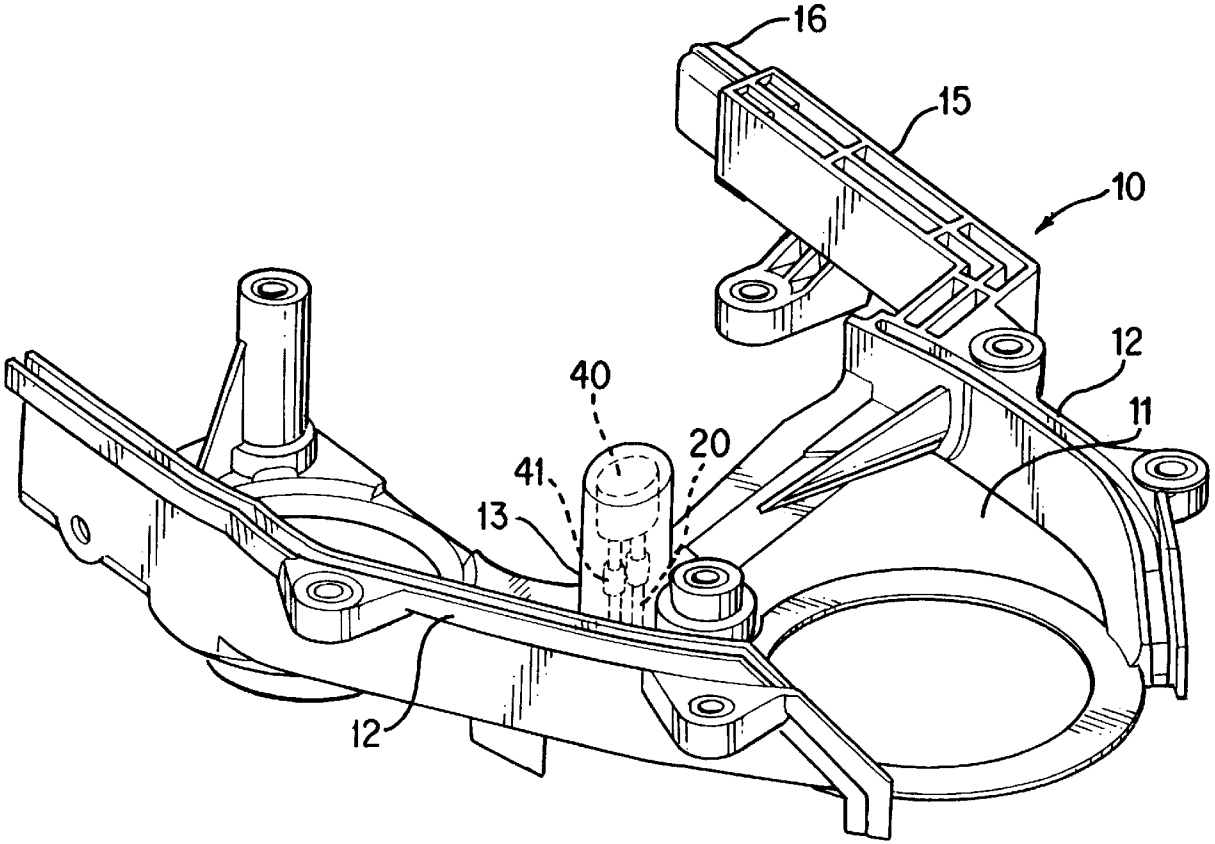
FIG. 13 is a diagonal view showing an insert moulded item of the second embodiment.
Figure 15:
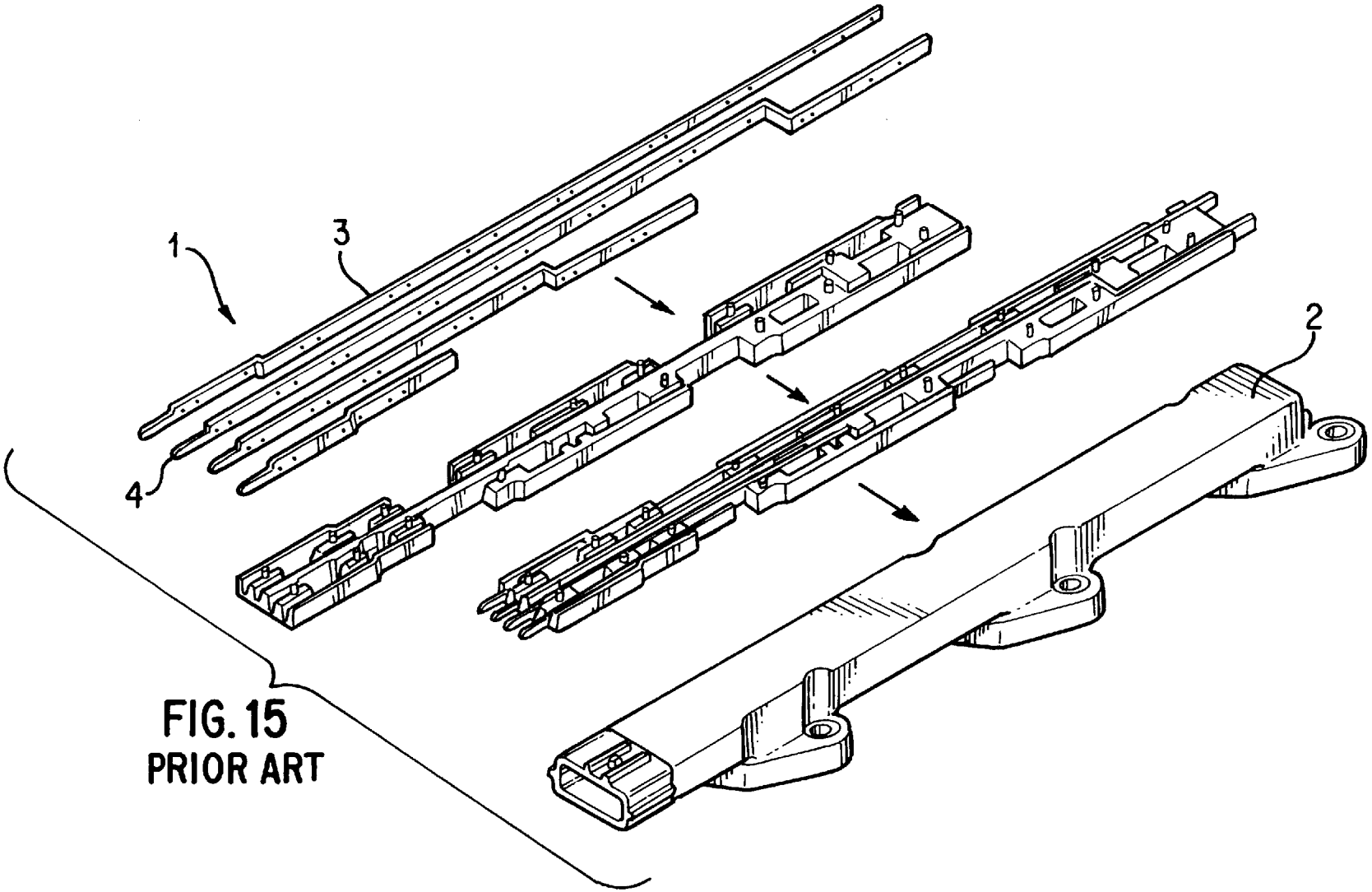
FIG. 15 PRIOR ART
FIG. 15 is a diagonal view showing a prior art insert moulded item.

The second embodiment is shown in FIGS. 13 and 14. Unlike the first embodiment, a connector member 14 is not provided at the anterior end of a tower 13; instead, a sensor 40 is provided, one end of a wiring member 20 connecting with this sensor 40. Specifically, the wiring member 20 is attached to a first moulded item 30 similar to that of the first embodiment, the sensor 40 being connected via an interrupt terminal 41 to the anterior end of the wiring member 20 protruding from the tower supporting protrusion 31. Further, the sensor 40 and the wiring member 20 are covered by means of a second moulded time. The rest of the members of the present embodiment are the same as those of the first embodiment and their explanation is accordingly omitted.

In the second embodiment, in addition to the effects of the first embodiment, by having the sensor 40 supported inside the housing 10, the sensor 40 does not move around, and the reliability of the connection between the wiring member 20 and the sensor 40 is improved.

The present invention is not limited to the embodiments described above with the aid of figures. For example, the possibilities described below also lie within the technical range of the present invention. In addition, the present invention may be embodied in various other ways without deviating from the scope thereof.

(1) The present invention is not limited to the belt cover described in the above embodiments. For example, it also applies to other insert moulded items such as integrated connectors, bulb sockets, etc., in which a wiring member is provided inside a housing.

(2) Although in the above embodiments the wires of the wiring members 20 are maintained so as to be in a non-contact state, it may equally be arranged so that they contact, or for example, another wiring member can be soldered on in a branching manner.

What is claimed is:

1. An insert moulded part having a plastic body and an elongated, electrical metal conductor encapsulated therein, the conductor being a one piece member with at least one end thereof protruding from said plastic body and an elongated medial section encapsulated in said plastic body, said protruding end having a flat tab shape to form an electrical contact member, and said elongated medial section having a substantially circular cross-section and being bent into a plurality of segments with a longitudinal axis of a first segment lying in a first plane and a longitudinal axis of a second segment lying in a second plane which is parallel to said first plane such that the first and second segments are not coplanar.

2. A part according to claim 1 wherein said conductor includes a second end protruding from said part, said second end having a flat tab shape to constitute an electrical connector.

3. A part according to claim 1 wherein said plastic body comprises a base moulding having a pre-defined path to receive said conductor, and an over-moulding to encapsulate said conductor.

4. A part according to claim 3 wherein said pre-defined path includes snap fitting jaws to receive said conductor.

5. A part according to claim 4 wherein said snap-fitting jaws are integrally moulded in said base moulding.

6. A part according to claim 1 further having a plurality of said conductors encapsulated side by side.

7. A part according to claim 6 wherein the protruding ends of said conductors are aligned in a third plane extending transverse to said first plane, and an encapsulated portion of said conductors are aligned side by side in said first plane.

8. A method of making an insert moulded part including an encapsulated electrical conductor, the method comprising the steps of a) moulding a base having a pre-defined conductor receiving path, said path having bends defining discrete segments which are not coplanar;

b) bending a one-piece, elongated metal conductor having a generally circular cross section into a pre-defined path having a plurality of segments with a longitudinal axis of a first segment of said conductor lying in a first plane and a longitudinal axis of a second segment of said conductor lying in a second plane which is parallel to said first plane such that the first and second segments of the conductor are not coplanar;

c) forming at least one end of the conductor into an electrical contact member having a flat tab shape after the bending of the conductor;

d) placing said bent conductor in said base so that said conductor follows said pre-defined conductor receiving path; and e) encapsulating said conductor by moulding a cover over said base, said tab end of said conductor being permitted to protrude from said base.

9. A method according to claim 8 wherein the step of moulding said base includes providing conductor restraining means to define said path.

10. A method according to claim 9 further comprising the step of molding snap fitting conductor restraining means in said base.

* * * * *